US005997761A

United States Patent [19]

Kaneko

[11] Patent Number: 5,997,761

[45] Date of Patent: Dec. 7, 1999

[54] REFRIGERATING MACHINE OIL COMPOSITION

[75] Inventor: Masato Kaneko, Ichihara, Japan

[73] Assignee: Idemitsu Kosan Co., Ltd., Tokyo, Japan

[21] Appl. No.: 09/179,889

[22] Filed: Oct. 28, 1998

Related U.S. Application Data

[62] Division of application No. 08/809,721, filed as application No. PCT/JP95/01832, Sep. 14, 1995.

[51] Int. Cl.[6] ..... C10M 169/04

[52] U.S. Cl. ..... 252/68; 508/162; 508/435; 508/436; 508/441

[58] Field of Search ..... 252/68; 508/162, 508/435, 436, 441

[56] References Cited

U.S. PATENT DOCUMENTS

| | | | |
|---|---|---|---|
| 2,780,597 | 2/1957 | Williams | 508/162 |
| 2,824,061 | 2/1958 | Davidson | 252/68 |
| 4,959,169 | 9/1990 | McGraw et al. . | |
| 5,064,546 | 11/1991 | Dasai | 508/441 |
| 5,262,076 | 11/1993 | Ishida et al. | 252/68 |
| 5,391,311 | 2/1995 | Ishida | 508/441 |
| 5,464,550 | 11/1995 | Sasaki et al. | 252/68 |
| 5,639,719 | 6/1997 | Tanaka et al. | 252/68 |

FOREIGN PATENT DOCUMENTS

| | | |
|---|---|---|
| 523561 | 1/1993 | European Pat. Off. . |
| 557104 | 8/1993 | European Pat. Off. . |
| 94/10268 | 5/1994 | WIPO . |

*Primary Examiner*—Jacqueline V. Howard
*Attorney, Agent, or Firm*—Oblon, Spivak, McClelland, Maier & Neustadt, P.C.

[57] ABSTRACT

A refrigerating machine oil composition which comprises, in the form of a blend, a base oil comprising a mineral oil or a synthetic oil and at least one species of an amine salt of an organic phosphoric acid, e.g. monooctylamine dioleyl phosphate.

13 Claims, No Drawings

REFRIGERATING MACHINE OIL COMPOSITION

This application is a division of application Ser. No. 08/809,721 filed on Apr. 7, 1997, which is the National Stage of International Application No. PCT/JP95/01832, filed Sep. 14, 1995 now U.S. Pat. No. 5,858,266.

TECHNICAL FIELD

The present invention relates to a refrigerating machine oil composition. More particularly, it pertains to a refrigerating machine oil composition which has excellent lubricating performance, enhances the lubricity between an aluminum material and a steel material, can suppress seizure and wear therebetween, does not bring about environmental pollution, and is well suited as the lubricating oil for a refrigerating machine using, as the refrigerant, a hydrogen-containing Flon compound such as 1,1,1,2-tetrafluoroethane.

BACKGROUND ART

A compression-type refrigerating machine is generally constituted of a compressor, a condenser, an expansion valve and an evaporator, and has a structure in which a mixed fluid of a refrigerant and a lubricating oil is circulated through the closed system. Heretofore, in the compression-type refrigerator, dichlorofluoromethane (R12), chlorodifluoromethane (R22) or the like has mainly been used as the refrigerant, and various types of mineral oil and synthetic oil have been used as the lubricant.

However, chlorofluorohydrocarbons, such as R12 and R22 described above, are being more rigorously restricted world-wide because of a fear of their bringing about environmental pollution such as the ozonosphere destruction. By this reason, hydrogen-containing Flon compounds [a "Flon compound" means a chlorofluorocarbon, a hydrofluorocarbon, and a hydrochlorofluorocarbon in general] such as hydrofluorocarbons and hydrochlorofluorocarbons are attracting attention as the novel types of refrigerant. The hydrogen-containing fluorocarbons, particularly hydrofluorocarbons, typified by 1,1,1,2-tetrafluoroethane (Flon 134a), are preferred as the refrigerant for compression-type refrigerating machines because they are free from the possibility of causing the ozonosphere destruction and can replace Flon 12 with little modification in the structure of refrigerating machines which have heretofore been used.

It is known that the above-mentioned new alternative Flon-based refrigerant is different in properties from the conventional Flon-based refrigerant, and that a blend is useful as a refrigerating machine oil to be employed therewith, which blend comprises a base oil such as a polyalkylene glycol, polyester, polyol ester, polycarbonate and polyvinyl ether, and any of a variety of additives such as an antioxidant, extreme pressure agent, antifoam and hydrolysis inhibitor.

However, the aforesaid refrigerating machine oil sufferes a serious problem in practice that it is poor in lubricating performance in the atmosphere of the above-mentioned refrigerant and in particular, it unfavorably increases the wear between an aluminum material and a steel material in a refrigerating machine for an automobile air conditioner or an electrical refrigerator. The frictional part between the aluminum material and the steel material is an element of lubricative importance as it is used between a piston and a piston shoe, a swash plate and a shoe, etc. in a reciprocating type compressor (especially, a swash plate type), and between a vane and a housing, etc. in a rotary type compressor.

On the other hand there are known a variety of antiwear improvers, but it is the actual circumstance at the present time that there is still unknown a method capable of effectively preventing the wear between the aluminum material and a steel material without impairing lubricating stability in a special atmosphere of a Flon compound.

DISCLOSURE OF THE INVENTION

It is an object of the invention to provide under such circumstances, a refrigerating machine oil composition which has excellent lubricating performance, enhances the lubricity between an aluminum material and a steel material, can suppress seizure and wear therebetween, does not bring about environmental pollution, and is well suited as the lubricating oil for a refrigerating machine using, as the refrigerant, a hydrogen-containing Flon compound such as R134a.

As a result of intensive research and investigation accumulated by the present inventors in order to develop a refrigerating machine oil composition which has aforesaid favorable properties, it has been found that the above-mentioned object can be achieved by blending a base oil composed of a mineral oil or a synthetic oil with a specific metallic salt or amine salt. The present invention has been accomplished by the foregoing finding and information.

Specifically, the present invention provides a refrigerating machine oil composition which comprises in the form of blend, a base oil composed of at least one member selected from the group consisting of a mineral oil and a synthetic oil and at least one species selected from the group consisting of a metallic salt of an inorganic phosphoric acid, an amine salt of an inorganic phosphoric acid, a metallic salt of an organic phosphoric acid, an amine salt of an organic phosphoric acid, a metallic salt of an organic phosphonic acid, an amine salt of an organic phosphonic acid, a metallic salt of an organic phosphorous acid and an amine salt of an organic phosphorous acid.

THE MOST PREFERRED EMBODIMENT TO CARRY OUT THE INVENTION

In the refrigerating machine oil composition according to the present invention, a mineral oil and/or a synthetic oil are used as the base oil. The mineral oil and the synthetic oil are not specifically limited provided that they are generally used as a base oil for a refrigerating machine oil. Preferably, they have a kinematic viscosity at 100° C. in the range of 1 to 100 cSt, particularly 2 to 60 cSt, more particularly 3 to 40 cSt. In the case where the kinematic viscosity thereof is lower than the lower limit of the aforesaid range, the refrigerating machine oil is poor in lubricity and sealability, whereas in the case of the kinematic viscosity thereof being higher than the higher limit thereof, the oil is poor in compatibility and low temperature fluidity. The pour point, that is, the index of low temperature fluidity of the base oil is not specifically limited, but is preferably minus 10° C. or lower.

A variety of such mineral oils and synthetic oils are available and may be suitably selected according to the purpose of use. The mineral oil is exemplified by paraffin-base mineral oil, naphthene-base mineral oil and intermediate base mineral oil, while the synthetic oil is exemplified by oxygen-containing organic compounds and hydrocarbon-based synthetic oils.

Examples of the above-mentioned oxygen-containing organic compounds in the synthetic oil include a synthetic oil containing an ether group, a ketone group, an ester group, a carbonate group, a hydroxyl group or the like, and a synthetic oil containing a hetero atom (such as S, P, F, Cl, Si and N) together with any of the foregoing groups, which are specifically exemplified by ① polyalkylene glycols, ② polyvinyl ethers, ③ polyesters, ④ polyol esters, ⑤ carbonate derivatives, ⑥ polyether ketones, and ⑦ fluorinated oils.

As ① the polyalkylene glycol described above, for example, mention is made of a compound represented by the general formula (I):

$$R^1—[(OR^2)_m—OR^3]_n \quad (I)$$

wherein $R^1$ represents hydrogen atom, an alkyl group having 1 to 10 carbon atoms, an acyl group having 2 to 10 carbon atoms, or an aliphatic hydrocarbon group having 1 to 10 carbon atoms and 2 to 6 parts for bonding; $R^2$ represents an alkylene group having 2 to 4 carbon atoms; $R^3$ represents hydrogen atom, an alkyl group having 1 to 10 carbon atoms, or an acyl group having 2 to 10 carbon atoms; n represents an integer of 1 to 6; and m represents such a number that the average of m×k is 6 to 80.

In the above general formula (I), the alkyl group represented by $R^1$ and $R^3$ may be linear, branched linear, or cyclic. Specific examples of the alkyl group include methyl group, ethyl group, n-propyl group, isopropyl group, various types of butyl group, various types of pentyl group, various types of hexyl group, various types of heptyl group, various types of octyl group, various types of nonyl group, various types of decyl group, cyclopentyl group, and cyclohexyl group. When the number of carbon atoms in the alkyl group is more than 10, the compatibility with Flon refrigerants is decreased, and phase separation occasionally takes place. The preferable number of carbon atoms in the alkyl group is 1 to 6.

The alkyl group in the acyl group represented by $R^1$ and $R^3$ may be linear, branched linear, or cyclic. Specific examples of the alkyl group include alkyl groups having 1 to 9 carbon atoms selected from the alkyl groups described as the examples of the alkyl group in the above. When the number of carbon atoms in the acyl group is more than 10, the compatibility with Flon refrigerants is decreased, and phase separation occasionally takes place. The preferably number of carbon atoms in the alkyl group is 2 to 6.

When $R^1$ and $R^3$ are both alkyl groups or acyl groups, $R^1$ and $R^3$ may be the same or different.

When n is 2 or more, the plurality of $R^3$ in one molecule may be the same as or different from each other.

When $R^1$ is an aliphatic hydrocarbon group having 1 to 10 carbon atoms and 2 to 6 parts for bonding, the aliphatic hydrocarbon group may be an open-chain group or a cyclic group. Examples of the aliphatic hydrocarbon group having 2 parts for bonding include ethylene group, propylene group, butylene group, pentylene group, hexylene group, heptylene group, octylene group, nonylene group, decylene group, cyclopentylene group, and cyclohexylene group. Examples of the aliphatic hydrocarbon group having 3 to 6 parts for bonding include residue groups formed by eliminating hydroxyl groups from polyhydric alcohols, such as trimethylpropane, glycerol, petaerythritol, sorbitol, 1,2,3-trihydroxycylohexane, and 1,3,5-trihydroxycyclohexane.

When the number of carbon atoms in the aliphatic hydrocarbon group is more than 10, the compatibility with Flon refrigerants is decreased, and phase separation occasionally takes place. The preferable number of carbon atoms in the alkyl group is 2 to 6.

$R^2$ in the above general formula (I) represents an alkylene group having 2 to 4 carbon atoms. Examples of the oxyalkylene group as the repeating unit include oxyethylene group, oxypropylene group, and oxybutylene group. A single type of the oxyalkylene group or 2 or more types of the oxyalkylene group may be contained in one molecule. It is preferred that at least the oxypropylene unit be contained in one molecule. It is particularly preferred that 50% or more by mol of the oxypropylene unit be contained in the oxyalkylene unit.

The letter "n" in the above general formula (I) represents an integer of 1 to 6 which is determined in accordance with the number of the parts for bonding in $R^1$. For example, when $R^1$ represents an alkyl group or an acyl group, n represents 1. When $R^1$ represents an aliphatic hydrocarbon group having 2,3,4,5 or 6 parts for bonding, n represents 2,3,4,5 or 6, respectively. The letter "m" represents such a number that the average of m×n is 6 to 80. When the average of m×n is outside the above range, the object of the present invention cannot sufficiently be achieved.

The polyalkylene glycol represented by the general formula (I) include polyalkylene glycols having hydroxyl groups at an end. When the content of the hydroxyl group at an end is 50% or less by mol of the total end groups, the polyalkylene glycol containing the hydroxyl group at an end can advantageously be used. However, when the content of the hydroxyl group at an end is more than 50% by mol; the polyalkylene glycol is not preferable because the polyalkylene glycol becomes more hygroscopic and the viscosity index is decreased.

As the polyalkylene glycol described above, polyoxypropylene glycol dimethyl ethers, polyoxyethylene polyoxypropylene glycol dimethyl ethers, polyoxypropylene glycol monobutyl ethers and polyoxypropylene glycol diacetate, are preferable in view of the economical efficiency and the effect.

As the polyalkylene glycol represented by the general formula (I), the compounds described in detail in the specification of Japanese Patent Application Laid-Open No. Heisei 2(1990)-305893 can also be used.

As ② the polyvinyl ether described above, for example, mention is made of a polyvinyl ether compound having the constituting unit represented by the general formula (II):

(II)

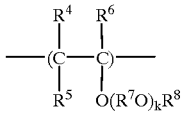

wherein $R^4$, $R^5$ and $R^6$ each represent hydrogen atom or hydrocarbon group having 1 to 8 carbon atoms and may be the same as or different from each other; $R^7$ represents a divalent hydrocarbon group having 1 to 10 carbon atoms or a divalent hydrocarbon group having 2 to 20 carbon atoms and an oxygen atom of the ether linkage; $R^8$ represents a hydrocarbon group having 1 to 20 carbon atoms; k represents a number for each repeating units, the average of which in the group is 0 to 10; $R^4$ to $R^8$ in a plurality of consituting units may the same as or different from each other; and when a plurality of $R^7O$ is contained, $R^7O$ may be the same or different.

There is also usable a polyvinyl ether compound composed of a block or random copolymer containing the constituting unit represented by the above general formula (II) and a constituting unit represented by the general formula (III):

(III)

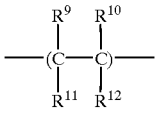

wherein $R^9$ to $R^{12}$ each represent hydrogen atom or a hydrocarbon group having 1 to 20 carbon atoms and may be the same as or different from each other, and $R^9$ to $R^{12}$ in a plurality of constituting units may be the same as or different from each other.

In the above general formula (II), $R^4$, $R^5$ and $R^6$ each represent hydrogen atom or a hydrocarbon group having 1 to 8 carbon atoms, preferably 1 to 4 carbon atoms, and may be the same as or different from each other. Specific examples of the hydrocarbon group include alkyl groups, such as methyl group, ethyl group, n-propyl group, isopropyl group, n-butyl group, isobutyl group, sec-butyl group, tert-butyl group, various types of pentyl group, various types of hexyl group, various types of heptyl group, and various types of octyl group; cycloalkyl groups, such as cyclopentyl group, cyclohexyl group, various types of methylcyclohexyl group, various types of ethylcycohexyl group, and various types of dimethylcyclohexyl group; aryl groups, such as phenyl group, various types of methylphenyl group, various types of ethylphenyl group, and various types of dimethylphenyl group; and arylakyl groups, such as benzyl group, various types of phenylethyl group and various types of methylbezyl group. As $R^4$, $R^5$ and $R^6$, hydrogen atom is particularly preferable.

In the general formula (II), $R^7$ represents a divalent hydrocarbon group having 1 to 10 carbon atoms, preferably 2 to 10 carbon atoms, or a divalent hydrocarbon group having 2 to 20 carbon atoms and an oxygen atom of the ether linkage. Specific examples of the divalent hydrocarbon group having 1 to 10 carbon atoms include divalent aliphatic groups, such as methylene group, ethylene group, phenylethylene group, 1,2-propylene group, 2-phenyl-1,2-propylene group, 1,3-propylene group, various types of butylene group, various types of pentylene group, various types of hexylene group, various types of heptylene group, various types of octylene group, various types of nonylene group, and various types of decylene group; alicyclic groups obtained by forming 2 parts for bonding in alicyclic hydrocarbons, such as cyclohexane, methylcyclohexane, ethylcyclohexane, dimethylcyclohexane, and propylcyclohexane; divalent aromatic hydrocarbon groups, such as various types of phenylene group, various types methylphenylene group, various types of ethylphenylene group, various types of dimethylphenylene group, and various types of naphthylene group; alkylaromatic groups having one monovalent part for bonding on each of the alkyl group and the aromatic group in alkylaromatic hydrocarbons, such as toluene, xylene, and ethylbenzene; and alkylaromatic groups having parts for bonding on the alkyl groups in polyalkylaromatic hydrocarbons, such as xylene and diethylbenzene. Among these compounds, aliphatic groups having 2 to 4 carbon atoms are particularly preferable.

Specific examples of the divalent hydrocarbon group having 2 to 20 carbon atoms and an oxygen atom of the ether linkage preferably include methoxymethylene group, methoxyethylene group, methoxymethylethylene group, 1,1-bismethoxymethylethylene group, 1,2-bismethoxymethylethylene group, ethoxymethylethylene group, (2-methoxyethoxy)methylethylene group, and (1-methyl-2-methoxy)methylethylene group. In the general formula (II), k represents the number of repeating of $R^8O$, the average of which is a number in the range of 0 to 10, preferably 0 to 5. When a plurality of $R^7O$ is contained, $R^7O$ may be the same as or different from each other.

In the general formula (II), $R^8$ represents a hydrocarbon group having 1 to 20 carbon atoms, preferably 1 to 10 carbon atoms. Specific examples of the hydrocarbon group include alkyl groups, such as methyl group, ethyl group, n-propyl group, isopropyl group, n-butyl group, isobutyl grou, sec-butyl group, tert-butyl group, various types of pentyl group, various types of hexyl group, various types of heptyl group, various types of octyl group, various types of nonyl group, and various types of decyl group; cycloalkyl groups, such as cyclopentyl group, cylohexyl group, various types of methylcyclohexyl group, various types of ethylcyclohexyl group, various types of propylcyclohexyl group, and various types of dimethylcyclohexyl group; aryl groups, such as phenyl group, various types of methylphenyl group, various types of ethylphenyl group, various types of dimethylphenyl group, various types of propylphenyl group, various types of trimethylphenyl group, various types of butylphenyl group, and various types of naphthyl group; and arylalkyl groups, such as benzyl group, various types of phenylethyl group, various types of methylbenzyl group, various types of phenylpropyl group, and various types of phenylbutyl group.

$R^4$ to $R^8$ in a plurality of constituting units may be the same as or different from each other.

The polyvinyl ether compound (1) having the constituting unit represented by the general formula (II) described above preferably has a carbon/oxygen molar ratio in the range of 4.2 to 7.0. When the carbon/oxygen molar ratio is less than 4.2, the polyvinyl ether compound is excessively hygroscopic. When the carbon/oxygen molar ratio is more than 7.0, the compatibility with Flon refrigerants is sometimes decreased.

In the general formula (III) described above, $R^9$ to $R^{12}$ each represent hydrogen atom or a hydrocarbon group having 1 to 20 carbon atoms and may be the same as or different from each other. Examples of the hydrocarbon group having 1 to 20 carbon atoms include the same groups as those described in the examples of $R^8$ in the general formula (II) described above. $R^9$to $R^{12}$ in a plurality of constituting units may be the same as or different form each other.

The polyvinyl ether compound (2) composed of a block or random copolymer containing the constituting unit represented by the general formula (II) described above and the constituting unit represented by the general formula (III) described above preferably has a carbon/oxygen molar ratio in the range of 4.2 to 7.0. When the carbon/oxygen molar ratio is less than 4.2, the polyvinyl ether compound is excessively hygroscopic. When the carbon/oxygen molar ratio is more than 7.0, the compatibility with Flon refrigerants is sometimes decreased.

In the present invention, a mixture of the polyvinyl ether compound (1) described above and the polyvinyl ether compound (2) also described above may also be used.

The polyvinyl ether compound (1) and the polyvinyl ether compound (2) used in the present invention can be prepared by polymerization of the corresponding vinyl ether monomer and copolymerization of the corresponding hydrocarbon monomer having an olefinic double bond and the corresponding vinyl ether monomer, respectively.

As the polyvinyl ether compound used in the present invention, the following compounds are preferable. One of the preferable compounds has one end group represented by the general formula (IV) or (V):

(IV)

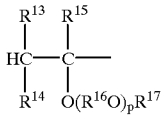

(V)

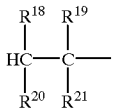

wherein $R^{13}$, $R^{14}$ and $R^{15}$ each represent hydrogen atom or a hydrocarbon group having 1 to 8 carbon atoms and may be the same as or different from each other; $R^{18}$, $R^{19}$, $R^{20}$ and $R^{21}$ each represent hydrogen atom or a hydrocarbon group having 1 to 20 carbon atoms and may be the same as or different from each other; $R^{16}$ represents a divalent hydrocarbon group having 1 to 10 carbon atoms or a divalent hydrocarbon group having 2 to 20 carbon atoms and an oxygen atoms of the ether linkage; $R^{17}$ represents a hydrocarbon group having 1 to 20 carbon atoms; p represents a number for each repeating units, the average of which in the group is 0 to 10; and when a plurality of $R^{16}O$ is contained, $R^{16}O$ may be the same as or different from each other and the other end group represented by the general formula (VI) or (VII):

(VI)

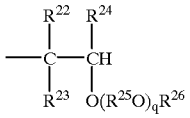

(VII)

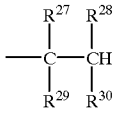

wherein $R^{22}$ , $R^{23}$ and $R^{24}$ each represent hydrogen atom or a hydrocarbon group having 1 to 8 carbon atoms and may be the same as or different from each other; $R^{27}$, $R^{28}$, $R^{29}$ and $R^{30}$ each represent hydrogen atom or a hydrocarbon group having 1 to 20 carbon atoms and may by the same as or different from each other; $R^{25}$ represents a divalent hydrocarbon group having 1 to 10 carbon atoms or a divalent hydrocarbon group having 2 to 20 carbon atoms and an oxygen atom of the ether linkage; $R^{26}$ represents a hydrocarbon group having 1 to 20 carbon atoms; q represents a number for each repeating units, the average of which is in the range of 0 to 10; and when a plurality of $R^{25}O$ is contained, $R^{25}O$ may be the same as or different from each other.

Another of the preferable compounds has one end group represented by the general formula (VI) or (VII) described above and the other end group represented by the general formula (VIII):

(VIII)

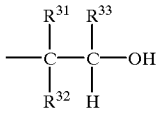

wherein $R^{31}$, $R^{32}$ and $R^{33}$ each represent hydrogen atom or a hydrocarbon group having 1 to 8 carbon atoms and may be the same as or different from each other.

Among the polyvinyl ether compounds described above, the following compounds are particularly preferable as the principal components of the refrigerating machine oil composition of the present invention.

(1) Compounds in which one end group has the structure represented by the general formula (IV) or (V), the other end group has the structure represented by the general formula (VI) or (VII), and in the general formula (II), $R^4$, $R^5$ and $R^6$ simultaneously represent hydrogen atoms, k represents a number of 0 to 4, $R^7$ represents a divalent hydrocarbon group having 2 to 4 carbon atoms, and $R^8$ represents a hydrocarbon group having 1 to 20 carbon atoms.

(2) Compounds having the constituting unit represented by the general formula (II) alone, in which one end group has the structure represented by the general formula (IV), the other end group has the structure represented by the general formula (VI), and in the general formula (II), $R^4$, $R^5$ and $R^6$ simultaneously represent hydrogen atoms, k represents a number of 0 to 4, $R^7$ represents a divalent hydrocarbon group having 2 to 4 carbon atoms, and $R^8$ represents a hydrocarbon group having 1 to 20 carbon atoms.

(3) Compounds in which one end group has the structure represented by the general formula (IV) or (V), the other end group has the structure represented by the general formula (VIII), and in the general formula (II), $R^4$, $R^5$ and $R^6$ simultaneously represent hydrogen atoms, k represents a number of 0 to 4, $R^7$ represents a divalent hydrocarbon group having 2 to 4 carbon atoms, and $R^8$ represents a hydrocarbon group having 1 to 20 carbon atoms.

(4) Compounds having the constituting unit represented by the general formula (II) alone, in which one end group has the structure represented by the general formula (IV), the other end group has the structure represented by the general formula (VII), and in the general formula (II), $R^4$, $R^5$ and $R^6$ simultaneously represent hydrogen atoms, k represents a number of 0 to 4, $R^7$ represents a divalent hydrocarbon group having 2 to 4 carbon atoms, and $R^8$ represents a hydrocarbon group having 1 to 20 carbon atoms.

In the present invention, there is also usable a polyvinyl ether compound having the constituting unit represented by the general formula (II) described above, one end group represented by the general formula (IV), and the other end group represented by the general formula (IX):

(IX)

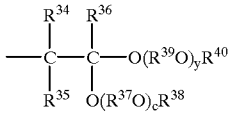

wherein $R^{34}$, $R^{35}$ and $R^{36}$ each represent hydrogen atom or a hydrocarbon group having 1 to 8 carbon atoms and may be the same as or different from each other; $R^{37}$ and $R^{39}$ each represent a divalent hydrocarbon group having 2 to 10 carbon atoms and may be the same or different; $R^{38}$ and $R^{40}$ each represent a hydrocarbon group having 1 to 10 carbon atoms; c and d each represent a number for each repeating unit, the average of which in the group is 0 to 10, and may be the same or different; $R^{37}O$ may be the same or different when a plurality of $R^{37}O$ are contained; and $R^{39}O$ may be the same or different when a plurality of $R^{39}O$ are contained. Furthermore, in the present invention, there is also usable a polyvinyl ether compound composed of a homopolymer or a copolymer of an alkyl vinyl ether having the constituting unit represented by the general formula (X) or (XI):

(X)

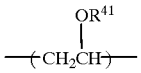

(XI)

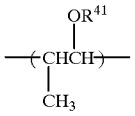

wherein $R^{41}$ represents a hydrocarbon group having 1 to 8 carbon atoms, a molecular weight of 300 to 1,200, and one end group represented by the general formula (XII) or (XIII):

(XII)

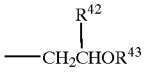

(XIII)

wherein $R^{42}$ represents an alkyl group having 1 to 3 carbon atoms, and $R^{43}$ represents a hydrocarbon group having 1 to 8 carbon atoms.

There is also usable as the polyvinyl ether compound, any of the compounds described in detail in the specifications of Japanese Patent Application Laid-Open No. Heisei 6(1994)-128578, Japanese Patent Application Laid-Open No. Heisei 6(1994)-234814, Japanese Patent Application Laid-Open No. Heisei 6(1994)-234815, and Japanese Patent Application No. Heisei 6(1994)-283349.

As ③ the polyester described above, for example, mention is made of an aliphatic polyester derivative having a constituting unit represented by the general formula (XIV):

(XIV)

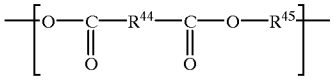

wherein $R^{44}$ represents an alkylene group having 1 to 10 carbon atoms, and $R^{45}$ represents an alkylene group having 2 to 10 carbon atoms or an oxaalkylene group having 4 to 20 carbon atoms and having a molecular weight of 300 to 2000.

In the general formula (XIV), $R^{44}$ represents an alkylene group having 1 to 10 carbon atoms. Specific examples of the alkylene group include methylene group, ethylene group, propylene group, ethylmethylene group, 1,1-dimethylethylene group, 1,2-dimethylethylene group, n-butylethylene group, isobutylethylene group, 1-ethyl-2-methylethylene group, 1-ethyl-1-methylethylene group, trimethylene group, tetramethylene group, and pentamethylene group. Alkylene groups having 6 or less carbon atoms are preferable. $R^{45}$ represnts an alkylene group having 2 to 10 carbon atoms or an oxaalkylene group having 4 to 20 carbon atoms. Specific examples of the alkylene group include the groups described above as the specific examples of the alkylene group represented by $R^{44}$ (except for methylene group). Alkylene groups heving 2 to 6 carbon atoms are preferable. Specific examples of the oxaalkylene group include 3-oxa-1,5-pentylene group, 3,6-dioxa-1,8-octylene group, 3,6,9-trioxa-1,11-undecylene group, 3-oxa-1,4-dimethyl-1,5-pentylene group,3,6-dioxa-1,4,7-trimethyl-1,8-octylene group, 3,6,9-trioxa-1,4,7,10-tetramethyl-1-11-undecylene group, 3-oxa-1,4-diethyl-1,5-pentylene group, 3,6-dioxa-1,4,7-triethyl-1,8-octylene group, 3,6,9-trioxa-1,4,7,10-tetraethyl-1,11-undecylene group, 3-oxa-1,1,4,4-tetramethyl-1,5-pentylene group, 3,6-dioxa-1,1,4,4,7,7-hexamethyl-1,8-octylene group, 3,6,9-trioxa-1,1,4,4,7,7,10,10-octamethyl-1,1,1-undecylene group, 3-oxa-1,2,4,5-tetramethyl-1,5-pentylene group, 3,6-dioxa-1,2,4,5,7,8-hexamethyl-1,8-octylene group, 3,6,9-trioxa-1,2,4,5,7,8,10,11-octamethyl-1,1,1-undecylene group, 3-oxa-1-methyl-1,5-pentylene group, 3-oxa-1-ethyl-1,5-pentylene group, 3-oxa-1,2-dimethyl-1,5-pentylene group, 3-oxa-1-methyl-4-ethyl-1,5-pentylene group, 4-oxa-2,2,6,6-tetramethyl-1,7-heptylene group, and 4,8-dioxa-2,2,6,6,10,10-hexamethyl-1,11-undecylene group. $R^{44}$ and $R^{45}$ in a plurality of constituting units may be the same as or different from each other.

The aliphatic polyester derivative represented by the above general formula (XIV) preferably has a molecular weight(measured by gel permeation chromatography (GPC)) of 300 to 2,000. When the molecular weight is less than 300, the kinematic viscosity is lower than the desirable range. When the molecular weight is more than 2,000, the aliphatic polyester derivative becomes waxy. Therefore, a molecular weight outside the specified range is not preferable.

As the aliphatic polyester derivative described above, the compounds described in detail in the specification of International Patent Application Laid-Open No. WO 91/07479 can also be used.

As ④ the polyol ester described above, a carboxylic acid ester of a polyhydric hydroxy compound containing at least 2 hydroxyl groups can be used. For example, a compound represented by the general formula (XV):

$$R^{46}[OCOR^{47}]_e \quad (XV)$$

can be used.

In the above general formula (XV), $R^{46}$ represents a hydrocarbon group which may be linear or branched linear, preferably an alkyl group having 2 to 10 carbon atoms, $R^{47}$ represents hydrogen atom or a hydrocarbon group having 1 to 22 carbon atoms, preferably an alkyl group having 2 to 16 carbon atoms, e represents an integer of 2 to 6, and a plurality of —$OCOR^{47}$ may be the same as or different from each other.

The polyol ester represented by the general formula (XV) can be obtained by reacting a polyhydric alcohol represented by the general formula (XVI):

$$R^{46}(OH)_e \quad (XVI)$$

wherein $R^{46}$ and e are the same as those described above, with a carboxylic acid represented by the general formula (XVII)

$$R^{47}COOH \quad (XVII)$$

wherein $R^{47}$ is the same as that described above, or a reactive derivative, such as an ester or a halide, of the carboxylic acid.

Examples of the polyhydric alcohol represented by the above general formula (XVI) include ethylene glycol, propylene glycol, butylene glycol, neopentyl glycol, trimethylolethane, trimethylolpropane, glycerol, pentaerythritol, dipentaerythritol, and sorbitol. Examples of the carboxylic acid represented by the above general formula (XVII) include propionic acid, butyric acid, valeric acid, caproic acid, heptanoic acid, 3-methylhexanoic acid, 2-ethylhexanoic acid, capric acid, decanoic acid, lauric acid, myristic acid and palmitic acid.

As 5 the carbonate derivative described above, for example, mention is made of a polycarbonate represented by the general formula (XVIII):

$$R^{48}O\underset{\underset{O}{\|}}{C}O[(R^{49}O)_f\underset{\underset{O}{\|}}{C}O]_gR^{50} \quad \text{(XVIII)}$$

wherein $R^{48}$ and $R^{50}$ each represent a hydrocarbon group having 30 or less carbon atoms or a hydrocarbon group having 2 to 30 carbon atoms and an ether linkage and may be the same or different, $R^{49}$ represents an alkylene group having 2 to 24 carbon atoms, f represents an integer of 1 to 100, and g represents an integer of 1 to 10.

In the above general formula (XVIII), $R^{48}$ and $R^{50}$ each represent a hydrocarbon group having 30 or less carbon atoms or a hydrocarbon group having 2 to 30 carbon atoms and an ether linkage. Specific examples of the hydrocarbon group having 30 or less carbon atoms include aliphatic hydrocarbon groups, such as methyl group, ethyl group, n-propyl group, isopropyl group, n-butyl group, isobutyl group, s-butyl group, t-butyl group, pentyl group, isopentyl group, neopentyl group, n-hexyl group, 1,3-dimethylbutyl group, 2,3-dimethylbutyl group, isohexyl group, n-heptyl group, isoheptyl group, 3-methylhexyl group, n-octyl group, 2-ethylhexyl group, isooctyl group, n-nonyl group, isononyl group, n-decyl group, isodecyl group, n-undecyl group, isoundecyl group, n-dodecyl group. isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isootadecyl group, n-nonadecyl group, isononadecyl group, n-eicosyl group, isoeicosyl group, and 2-(4-methylpentyl) group; alicyclic hydrocarbon groups, such as cyclohexyl group, 1-cyclohexenyl group, methylcycloxyl group, dimethylcyclohexyl group, decahydronaphthyl group, and tricyclodecanyl group; aromatic hydrocarbon groups, such as phenyl group, o-tolyl group, p-tolyl group, m-tolyl group, 2,4-xylyl group, mesityl group, and 1-naphthyl group; and aromatic-aliphatic hydrocarbons, such as benzyl group, methylbenzyl group, β-phenylethyl group (phenethyl group), 1-phenylethyl group, 1-methyl-1-phenylethyl group, p-methylbenzyl group, styryl group, and cinnamyl group.

As the hydrocarbon group having 2 to 30 carbon atoms and an ether linkage, for example, mention is made of a glycol ether group represented by the general formula (XXI):

$$-(R^{51}-O)_h-R^{52} \quad \text{(XIX)}$$

wherein $R^{51}$ represents an alkylene group having 2 or 3 carbon atoms, such as ethylene group, propylene group, and trimethylene group, $R^{52}$ represents an aliphatic, alicyclic, or aromatic hydrocarbon group each having 28 or less carbon atoms, such as the groups described as examples of the group represented by $R^{48}$ and $R^{50}$, and h represents an integer of 1 to 20. Specific examples of the glycol ether group represented by the general formula (XIX) include ethylene glycol monomethyl ether group, ethylene glycol monobutyl ether group, diethylene glycol mono-n-butyl ether group, triethylene glycol monoethyl ether group, propylene glycol monomethyl ether group, propylene glycol monobutyl ether group, dipropylene glycol monoethyl ether group, and tripropylene glycol mono-n-butyl ether group. Preferable groups among the groups described above are alkyl groups, such as n-butyl group, isobutyl group, isoamyl group, cyclohexyl group, isoheptyl group, 3-methylhexyl group, 1,3-dimethylbutyl group, hexyl group, octyl group, and 2-ethylhexyl group; and alkylene glycol monoalkyl ether groups, such as ethylene glycol monomethyl ether group, ethylene glycol monobutyl ether group, diethylene glycol monomethyl ether group, triethylene glycol monomethyl group, propylene glycol monomethyl ether group, propylene glycol monobutyl ether group, dipropylene glycol monoethyl ether group, and tripropylene glycol mono-n-butyl ether group.

$R^{48}$ and $R^{50}$ described above may be the same or different.

In the above general formula (XVIII), $R^{49}$ represents an alkylene group having 2 to 24 carbon atoms, specifically examplified by ethylene group, propylene group, butylene group, amylene group, methylamylene group, ethylamylene group, hexylene group, methylhexylene group, ethylhexylene group, octamethylene group, nonamethylene group, decamethylene group, dodecamethylene group, and tetradecamethylene group, f represents an integer of 1 to 100, and g represents an integer of 1 to 10. When a plurality of $R^{49}O$ are contained, $R^{49}O$ may be the same as or different from each other.

The polycarbonate represented by the general formula (XVIII) preferably has a molecular weight (a weight-average molecular weight) of 300 to 3,000, more preferably 400 to 1,500. When the molecular weight is less than 300, the polycarbonate has a kinematic viscosity lower than the desirable range and is unsuitable as the lubricant. When the molecular weight is more than 3,000, the polycarbonate becomes waxy, and the application as the lubricant is difficult.

The polycarbonate can be produced in accordance with any of various processes and is generally produced by using a carbonic acid diester or a derivative which can form a carbonic acid ester such as phosgen, and an aliphatic dihydric alcohol as the starting materials.

For producing the polycarbonate from the above materials, a conventional process for producing a polycarbonate can be used. In general, the transesterification process or the phosgen process can be used.

As the polycarbonate, the compounds described in detail in the specification of Japanese Patent Application Laid-Open No. Heisei 3(1991)-217495 can also be used.

As the carbonate derivative, there is also usable a glycol ether carbonate represented by the general formula (XX):

$$R^{53}-O-(R^{55}O)_i-CO-(OR^{56})_j-O-R^{54} \quad \text{(XX)}$$

wherein $R^{53}$ and $R^{54}$ each represent an aliphatic, alicyclic, aromatic, or aromatic-aliphatic hydrocarbon group having 1 to 20 carbon atoms and may be the same or different from each other, $R^{55}$ and $R^{56}$ each represent ethylene group or isopropylene group and may be the same or different, and i and j each represent a number of 1 to 100.

In the above general formula (XX), specific examples of the aliphatic hydrocarbon group represented by $R^{53}$ and $R^{54}$ include methyl group, ethyl group, propyl group, isopropyl group, isobutyl group, s-butyl group, t-butyl group, pentyl group, isopentyl group, neopentyl group, n-hexyl group, isohexyl group, n-heptyl group, isoheptyl group, n-octyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isooctadecyl group, n-nonyldecyl group, isononyldecyl group, n-eicosyl group, and isoeicosyl group. Specific examples of the alicyclic hydrocarbon group include cyclohexyl group, 1-cycyclohexenyl group, methylcyclohexyl group, dimethylcyclohexyl group, decahydronaphthyl group, and tricyclodecanyl group. Specific examples of the aromatic hydrocarbon group include phenyl group, o-tolyl group, p-tolyl group, m-tolyl group, 2,4-xylyl group, mesityl group, and 1-naphthyl group. Specific examples of the aromatic-aliphatic hydrocarbon group include benzyl group, methylbenzyl group, phenylethyl group, styryl group, and cinnamyl group.

The glycol ether carbonate represented by the above general formula (XX) can be produced, for example, by transesterification of a polyalkylene glycol monoalkyl ether in the presence of an excess amount of a carbonic acid ester of an alcohol having a relatively low boiling point.

As the glycol ether carbonate described above, the compounds described in detail in the specification of Japanese Patent Application Laid-Open No. Heisei 3(1991)-149295 can also be used.

As the carbonate derivative, there is also usable a carbonic acid ester represented by the general formula (XXI):

(XXI)

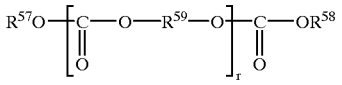

wherein $R^{57}$ and $R^{58}$ each represent an alkyl group having 1 to 15 carbon atoms or a residue group of a dihydric alcohol having 2 to 12 carbon atoms and may be the same or different, $R^{59}$ represents an alkylene group having 2 to 12 carbon atoms, and r represents an integer of 0 to 30.

In the above general formula (XXI), $R^{57}$ and $R^{58}$ each represent an alkyl group having 1 to 15 carbon atoms, preferably 2 to 9 carbon atoms, or a residue group of a dihydric alcohol having 2 to 12 carbon atoms, preferably 2 to 9 carbon atoms, $R^{59}$ represents an alkylene group having 2 to 12 carbon atoms, preferably 2 to 9 carbon atoms, and r represents an integer of 0 to 30, preferably 1 to 30. A carbonic acid ester which does not satisfy the above conditions is not preferable because the product obtained by using it is inferior in various properties, such as the compatibility with Flon refrigerants. Specific examples of the alkyl group having 1 to 15 carbon atoms which is represented by $R^{57}$ and $R^{58}$ include methyl group, ethyl group, n-propyl group, n-butyl group, n-pentyl group, n-hexyl group, n-heptyl group, n-octyl group, n-nonyl group, n-decyl group, n-undecyl group, n-dodecyl group, n-tridecyl group, n-tetradecyl group, n-pentadecyl group, isopropyl group, isobutyl group, tert-butyl group, isopentyl group, isohexyl group, isoheptyl group, isoocyl group, isononyl group, isodecyl group, isoundecyl group, isododecyl group, isotridecyl group, isotetradecyl group, and isopentadecyl group.

Specific examples of the residue group of a dihydric alcohol having 2 to 12 carbon atoms include residue groups formed from ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol.

Specific examples of alkylene group having 2 to 12 carbon atoms which is represented by $R^{59}$ include alkylene groups having linear structures or branched structures, such as ethylene group, trimethylene group, propylene group, tetramethylene group, butylene group, 2-methyltrimethylene group, pentamethylene group, 2,2-dimethyltrimethylene group, hexamethylene group, 2-ethyl-2-methyltrimethylene group, heptamethylene group, 2-methyl-2-propyltrimethylene group, 2,2-diethyltrimethylene group, octamethylene group, nonamethylene group, decamethylene group, undecamethylene group, and dodecamethylene group.

The molecular weight of the carbonic acid ester described above is not particularly limited. Carbonic acid esters having a number-average molecular weight of 200 to 3,000 is preferably used because of the improved property of sealing the compressor. Carbonic acid ester having a number-average molecular weight of 300 to 2,000 is more preferably used.

As the carbonic acid ester described above, there is also usable the compounds described in detail in the specification of Japanese Patent Application Laid-Open No. Heisei 4(1992)-63893.

As ⑥ the polyether ketone described above, for example, mention is made of a compound represented by the general formula (XXII):

(XXII)

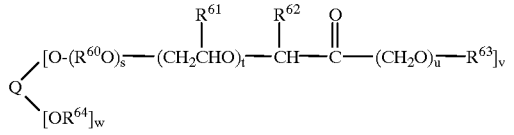

wherein Q represents a residue group of an alchol having a functionality of 1 to 8; $R^{60}$ represents an alkylene group having 2 to 4 carbon atoms; $R^{61}$ represents methyl group or ethyl group; $R^{62}$ and $R^{64}$ each represent hydrogen atom, an aliphatic, aromatic, or aromatic-aliphatic hydrocarbon group each having 20 or less carbon atoms, and may be the same or different; $R^{63}$ represents an aliphatic, aromatic, or aromatic-aliphatic hydrocarbon group each having 20 or less carbon atoms; s and t each represent a number of 0 to 30; v represents a number of 1 to 8, w represents a number of 0 to 7, and v+w is in the range of 1 to 8; and u represents 0 or 1.

In the above general formula (XXII), Q represents a residue group of an alcohol having a functionality of 1 to 8. Examples of the alcohol having Q as the residue group include monohydric alcohols, such as aliphatic monohydric alcohols such as methyl alcohol, ethyl alcohol, linear and branched propyl alcohols, linear and branched butyl alcohols, linear and branched pentyl alcohols, linear and branched hexyl alcohols, linear and branched heptyl alcohols, linear and branched octyl alcohols, linear and branched nonyl alcohols, linear and branched decyl alcohols, linear and branched undecyl alcohols, linear and branched dodecyl alcohols, linear and branched tridecyl alcohols, linear and branched tetradecyl alcohols, linear and branched pentadecyl alcohols, linear and branched hexadecyl alcohols, linear and branched heptadecyl alcohols, linear and branched octadecyl alcohols, linear and branched nonadecyl alcohols, and linear and branched eicosyl alcohols, aromatic alcohols such as phenol, methylphenol, nonylphenol, octylphenol, and naphthol, aromatic-aliphatic alcohols such as benzyl alcohol and phenylethyl alcohol, and compounds obtained by partial etherification of these alcohols; dihydric alcohols, such as linear and branched aliphatic alcohols such as ethylene glycol, propylene glycol, butylene glycol, neopentyl glycol, and tetramethylene glycol, aromatic alcohols such as catechol, resorcinol, bisphenol A, and bisphenyldiol, and compounds obtained by partial etherification of these compounds; trihydric alcohols, such as linear and branched aliphatic alcohols such as glycerol, trimethylolpropane, trimethylolethane, trimethylolbutane, and 1,3,5-pentanetriol, aromatic alcohols such as pyrogallol, methylpyrogallol, and 5-sec-butylpyrogallol, and compounds obtained by partial etherification of these alcohols; and alcohols having a functionality of 4 to 8, such as aliphatic alcohols exemplified by pentaerythritol, diglycerol, sorbitane, triglycerol, sorbitol, dipentaerythritol, tetraglycerol, pentaglycerol, hexaglycerol, tripentaerythritol, and compounds obtained by partial etherification of these alcohols.

In the above general formula (XXII), the alkylene group having 2 to 4 carbon atoms which is represented by $R^{60}$ may be linear or branched. Specific examples of the alkylene group include ethylene group, propylene group, ethylethylene group, 1,1-dimethylethylene group, and 1,2-dimethylethylene group. Examples of the aliphatic, aromatic, or aliphatic-aromatic hydrocarbon group each having 20 or less carbon atoms which is represented by $R^{62}$ to $R^{64}$ include linear alkyl groups, such as methyl group, ethyl group, propyl group, butyl group, pentyl group, heptyl group, octyl group, nonyl group, decyl group, undecyl group, lauryl group, myristyl group, palmityl group, and stearyl group; branched alkyl groups, such as isopropyl group, isobutyl group, isoamyl group, 2-ethylhexyl group, isostearyl group, and 2-heptylundecyl group; aryl groups, such as phenyl group and methylphenyl group; and arylalkyl groups, such as benzyl group.

In the general formula (XXII), s and t each represent a number of 0 to 30. When s or t is more than 30, the contribution of the ether group in the molecule increases, and the polyether ketone is not preferable with respect to the compatibility with Flon refrigerants, the electric insulating property, and the hygroscopic property. Therein, v represents a number of 1 to 8, w represents a number of 0 to 7, v and w satisfy the relation that v+w is in the range of 1 to 8, these numbers are average numbers and not limited to integers, u represents 0 or 1, a plurality of $R^{60}$ in the number represented by s×v may be the same as or different from each other, and a plurality of $R^{61}$ in the number represented by t×v may be the same as or different from each other. When v represents 2 or more, pluralities of s,t,u, $R^{62}$, and $R^{63}$ each in the number represented by v may be the same as or different from each other. When w represents 2 or more, a plurality of $R^{64}$ in the number represented by w may be the same as or different from each other.

As the process for producing the polyether ketone represented by the general formula (XXII), a generally known process can be used. For example, there is usable a process in which a secondary alkyloxyalcohol is oxidized by a hypochlorite and acetic acid (Japanese Patent Application laid-Open No. Heisei 4(1992)-126716) or a process in which a secondary alkyloxyalcohol is oxidized by zirconium hydroxide and a ketone (Japanese Patent Application Laid-Open No. Heisei 3(1991)-167149).

As ⑦ the fluorinated oil described above, for example, mention is made of a fluorinated silicone oil, a perfluoropolyether and a reaction product between an alkane and a perfluoro(alkylvinyl ether). Examples of the reaction product between an alkane and a perfluoro(alkylvinyl ether) include a compound represented by the general formula (XXV):

$$C_nH_{(2n+2-z)}(CF_2{=}CFHOC_mF_{2m+1})_z \quad \text{(XXV)}$$

wherein z is an integer of from 1 to 4, n is an integer of from 6 to 20, and m is an integer of from 1 to 4, which compound is obtained by reacting an alkane represented by the general formula (XXIII):

$$C_nH_{2n+2} \quad \text{(XXIII)}$$

wherein n is as previously defined, with a perfluoro (alkylvinyl ether) represented by the general formula (XXIV):

$$CF_2{=}CFOC_mF_{2m+1} \quad \text{(XXIV):}$$

wherein m is as previously defined.

The alkane represented by the above-mentioned general formula (XXIII) may be any of linear, branched linear and cyclic, and is specifically exemplified by n-octane, n-decane, cyclooctane, cyclododecane and 2,2,4-trimethylpentane. On the other hand, the perfluoro(alkylvinyl ether) represented by the general formula(XXIV) is specifically exemplified by perfluoro(methylvinyl ether), perfluoro(ethylvinyl ether), perfluoro(n-propylvinyl ether) and perfluoro(n-butylvinyl ether).

Aside from the foregoing, the hydrocarbon-based synthetic oil is exemplified by an olefinic polymer such as poly-α-olefin as well as an alkylbenze, alkylnaphthalene and the like.

In the refrigerating machine oil composition according to the present invention, the above-mentioned mineral oil may be used alone or in combination with at least one other as the base oil, the aforesaid synthetic oil may be used alone or in combination with at least one other as the base oil, and there may be used in combination, at least one mineral oil and at least one synthetic oil. In particular, an oxygen-containing organic compound is preferable because of its favorable compatibility with a Flon referigerant such as R-134a and excellent lubricating performance.

In the refrigerating machine oil according to the present invention, the base oil is blended with at least one species selected from the group consisting of a metallic salt of an inorganic phosphoric acid, an amine salt of an inorganic phosphoric acid, a metallic salt of an organic phosphoric acid, an amine salt of an organic phosphoric acid, a metallic salt of an organic phosphonic acid, an amine salt of an organic phosphonic acid, a metallic salt of an organic phosphorous acid and an amine salt of an organic phosphorous acid, wherein the amine salt is meant to include an ammonium salt.

The metal in the above-mentioned metallic salt of an inorganic phosphoric acid is not specifically limited in its kind, but is exemplified by lithium, potassium, sodium, magnesium, calcium, strontium, nickel and aluminum. Of these, alkali metals and alkaline earth metals are preferable, among which alkali metals are particularly preferable from the viewpoint of improvement in lubricating performance. As the preferable metallic salt of an inorganic phosphoric acid, mention is made of potassium phosphate, sodium phosphate, potassium hydrogenphosphate, sodium hydrogenphosphate, potassium dihydrogenphosphate, sodium dihydrogenphosphate, potassium diphosphate, sodium diphosphate and the like.

In addition, the amine in the amine salt of an inorganic phosphoric acid is not specifically limited in its kind, but is exemplified by ammonia, monohydrocarbylamine, dihydrocarbylamine and trihydrocarbylamine. As the hydrocarbyl group in the aforementioned hydrocarbylamine, mention is made of a saturated alkyl group, an unsaturated alkyl group (e.g. alkenyl group), an aromatic hydrocarbon group and the like each having 1 to 40, preferably 1 to 20 carbon atoms. Of these, a saturated or unsaturated alkyl group having aforesaid carbon atoms is preferable from the viewpoint of improvement in lubricating performance. Specific examples of the foregoing amine salt of an inorganic phosphoric acid include octylamine phosphate, bis(monooctylamine) phosphate, tris(monooctylamine) phosphate, mono (trioctylamine) phosphate and bis(dioctylamine) phosphate.

The metal in the metallic salt of an organic phosphoric acid is not specifically limited in its kind, but is preferably exemplified by alkali metals and alkaline earth metals, especially alkali metals as is the case with the metallic salt of an inorganic phosphoric acid.

As the above-mentioned metallic salt of an organic phosphoric acid, mention is made of a metallic salt of an organic phosphoric acid represented by the general formula (XXVI):

(XXVI)

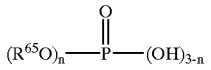

wherein $R^{65}$ is an aliphatic, alicyclic, aromatic or aromatic-aliphatic hydrocarbon group, and n is 1 or 2, by the general formula (XXVII):

(XXVII)

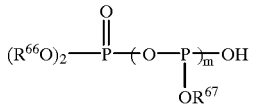

wherein $R^{66}$ and $R^{67}$ are each hydrogen atom, or an aliphatic, alicyclic, aromatic or aromatic-aliphatic hydrocarbon group and may be the same as or different from each other, but at least one of them is a hydrocarbon group, and m is an integer of from 1 to 4, or by the general formula (XXVIII):

(XXVIII)

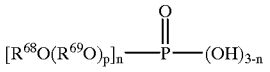

wherein $R^{68}$ is an aliphatic, alicyclic, aromatic or aromatic-aliphatic hydrocarbon group; $R^{69}$ is an alkylene group having 2 to 4 carbon atoms; p is a number in the range of from 1 to 10; and n is 1 or 2.

The aliphatic hydrocarbon group among the hydrocarbon groups represented by any of $R^{65}$ to $R^{68}$ in the organic phoshoric acid represented by any of the general formulae (XXVI), (XXVII) and (XXVIII) is an alkyl group or an alkenyl group having 1 to 40, preferably 4 to 20 carbon atoms, and is exemplified by methyl group, ethyl group, n-propyl group, isopropyl group, isobutyl group, s-butyl group, t-butyl group, pentyl group, isopentyl group, neopentyl group, n-hexyl group, isohexyl group, n-heptyl group, isoheptyl group, n-octyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isooctadecyl group, n-nonadecyl group, isononadecyl group, n-eicosyl group, isoeicosyl group, and oleyl group. The alicyclic hydrocarbon group among the same is a cycloalkyl group or a cycloalkenyl group having 5 to 40, preferably 5 to 20 carbon atoms, and is exemplified by cyclopentyl group, cyclohexyl group, 1-cyclohexenyl group, methylcyclohexyl group, cyclooctyl group, and decahydronaphthyl group. The aromatic hydrocarbon groups among the same is an aryl group having 6 to 40, preferably 6 to 20 carbon atoms, and is exemplified by phenyl group, tolyl group, xylyl group, and naphthyl group. The aromatic-aliphatic hydrocarbon among the same is an arylalkyl group having 7 to 40, preferably 7 to 20 carbon atoms or an arylalkenyl group having 8 to 20 carbon atoms, and is exemplified by benzyl group, phenethyl group, styryl group, and cinnamyl group. The hydrocarbon group represented by any of the aforesaid $R^{65}$ to $R^{68}$ is preferably an alkyl group or an alkenyl group from the viewpoint of improvement in lubricating performance.

In the general formula (XXVI), n is 1 or 2, and when n is 2, two $R^{65}$ may be the same or different. In the general formula (XXVII), m is an integer of from 1 to 4, $R^{66}$ and $R^{67}$ may be the same or different, two $R^{66}$ may be the same or different, but at least one out of $R^{66}$ and $R^{67}$ is a hydrocarbon group. In the general formula (XXVIII), $R^{69}$ is an alkylene group having 2 to 4 carbon atoms and is specifically exemplified by ethylene group, propylene group, trimethylene group, butylene group and tetramethylene group, and p is a number in the range of from 1 to 10, showing the average molar number of the added alkylene oxide.

Specific examples of such metallic salt of an organic phosphoric acid include dipotassium methyl phosphate, disosium methyl phosphate, dipotassium butyl phosphate, disodium butyl phosphate, depotassium lauryl phosphate, disodium lauryl phosphate, dipotassium oleyl phosphate, disodium oleyl phoshate, potassium dilauryl phosphate, sodium dilauryl phosphate, potassium dioleyl phosphate, sodium dioleyl phosphate, dipotassium phosphate lauryl ether (4 mols ethylene oxide being added), disodium phosphate lauryl ether (4 mols ethylene oxide being added), dipotassium phoshate oleyl ether (8 mols ethylene oxide being added) and disodium phosphate oleyl ether (8 mols ethylene oxide being added).

As the organic phosphoric acid in the above-mentioned amine salt of an organic phosphoric acid, there are usable the organic phosphoric acids same as those in the case of the aforestated metallic salt of an organic phosphoric acid. Likewise, the hydrocarbon group represented by any of $R^{65}$ to $R^{68}$ is preferably exemplified by an alkyl group and an alkenyl group from the viewpoint of improvement in lubricating performance. As the amine therein, there are usable the amines same as those in the case of the aforesid amine salt of an inorganic phosphoric acid. The hydrocarbyl group is preferably an alkyl group or an unsaturated alkyl group from the viewpoint of improvement in lubricating performance.

Specific examples of such amine salt of an organic phosphoric acid include ammonium oleyl phosphate, monooctylamine dioleyl phosphate, bisdecylamine oleyl phosphate, mono(trioctylamine) dioleyl phosphate and bis (dioctylamine) lauryl phosphate.

On the other hand, the metal in the metallic salt of an organic phosphonic acid is not specifically limited in its kind, but is preferably exemplified by alkali metals and alkaline earth metals, especially alkali metals as is the case with the metallic salt of an inorganic phosphoric acid.

The above-mentioned metallic salt of an organic phosphonic acid is exemplified by a metallic salt of an organic phosphonic acid represented by the general formula (XXIX):

(XXIX)

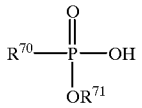

wherein $R^{70}$ is an aliphatic, alicyclic, aromatic or aromatic aliphatic hydrocarbon group and $R^{71}$ is hydrogen atom, or an aliphatic, alicyclic, aromatic or aromatic aliphatic hydrocarbon group.

Among the hydrocarbon group denoted by any of $R^{70}$ and $R^{71}$ in the organic phosphonic acid represented by the general formula (XXIX), the aliphatic hydrocarbon group is an alkyl group or an alkenyl group each having 1 to 40, preferably 4 to 20 carbon atoms; the alicyclic hydrocarbon group is a cycloalkyl group or a cycloalkenyl group each having 5 to 40, preferably 5 to 20 carbon atoms; the aromatic hydrocarbon group is an aryl group having 6 to 40, preferably 6 to 20 carbon atoms; and the aromatic aliphatic hydrocarbon group is an arylalkyl group having 7 to 40, preferably 7 to 20 carbon atoms, or an arylalkenyl group having 8 to 20 carbon atoms. These hydrocarbon groups are specifically exemplified by those having been exemplified in the description of the hydrocarbon groups denoted by any of $R^{65}$ to $R^{68}$.

Specific examples of the metallic salt of an organic phosphonic acid include dipotassium methyl phosphonate, disodium methyl phosphonate, dipotassium butyl phosphonate, disodium butyl phosphonate, dipotassium lauryl phosphonate, disodium lauryl phosphonate, dipotassium oleyl phosphonate and disodium oleyl phosphonate.

There is usable a mono- or di-hydrocarbylphosphonic acid as the organic phosphonic acid in the amine salt of an organic phosphonic acid. As the hydrocarbyl group, mantion is made of a saturated alkyl group, an unsaturated alkyl group (e.g. alkenyl group) and an aromatic hydrocarbon group, among which a saturated alkyl group and an unsaturated alkyl group such as an alkenyl group are particularly preferable from the viewpoint of improvement in lubricating performance. In particular, there are usable, in the amine salt of an organic phosphonic acid according to the present invention, the organic phosphonic acids same as those in the case of the metallic salt of an organic phosphonic acid. As the amine in the aforesaid amine salt of the organic phosphonic acid, mention is made of the amine same as in the amine salt of the inorganic phosphonic acid. The hydrocarbyl group is preferably an alkyl group or an unsaturated alkyl group from the viewpoint of improvement in lubricating performance.

Specific examples of such amine salt of the organic phosphonic acid include octylamine dioleyl phosphonate and octylamine dilauryl phosphonate.

The metal in the metallic salt of an organic phosphorous acid is not specifically limited in its kind, but is preferably exemplified by alkali metals and alkaline earth metals, especially alkali metals as is the case with the metallic salt an inorganic phosphoric acid. As the metallic salt of an organic phosphorous acid, there is usable a metallic salt of the organic phosphorous acid represented by the general formula obtained by eliminating =O which is directly bonded to P in any of the above-mentioned general formulae (XXVI) to (XXIX). Specific examples of such metallic salt of the organic phosphorous acid include sodium dioleyl phosphite, potassium dilauryl phosphate, dipotassium oleyl phosphate and disodium lauryl phosphite.

As the organic phosphorous acid in the amine salt of an organic phosphorous acid, there are usable the organic phosphorous acids same as those in the case of the above-mentioned metallic salt of an organic phosphorous acid. As the amine therein, there are usable the amines same as those in the case of the foregoing amine salt of an inorganic phosphoric acid. The hydrocarbyl group is preferably an alkyl group or an unsaturated alkyl group from the viewpoint of improvement in lubricating performance. Specific examples of such amine salt of an organic phosphorous acid include octylamine dioleyl phosphate, octylamine dilauryl phosphite, bisoctylamine oleyl phosphate and bisoctylamine lauryl phosphate.

Of the above-mentioned metallic salts and amine salts in the present invention, alkali metal salts and amine salts are particularly preferable from the viewpoint of improvement in lubricity between aluminum and steel. Moreover, there is preferably usable each of metallic salts and amine salts of any of the organic phosphoric acid, organic phosphonic acid and organic phosphorous acid from the viewpoint of solubility in the base oil, and the like.

In the refrigerating machine oil composition according to the present invention, the metallic salt or amine salt each derived from the acid containing phosphorus may be used alone or in combination with at least one other. The blending amount of such salt is preferably in the range of from 0.001 to 10% by weight based on the whole amount of the composition. A blending amount, when less than 0.001% by weight, leads to failure to sufficiently exert the working effect on enhancement in lubricity, whereas an amount, when more than 10% by weight, results in failure to enhance the working effect in proportion to the amount used, and besides lowers the solubility in the base oil. The blending amount is in the range of preferably from 0.01 to 5% by weight, particularly preferably from 0.03 to 3% by weight from the viewpoint of working effect on enhancement in lubricity and solubility in the base oil.

The refrigerating machine oil composition according to the present invention may be incorporated with a dissolution aid according to the demand. Examples of the dissolution aid include a monohydric alcohol, a glycol, a polyhydric alcohol and a clathrate compound. The monohydric alcohol is exemplified by lauryl alcohol, palmityl alcohol and oleyl alcohol. The glycol is exemplified by an alkylene glycol such as ethylene glycol and propylene glycol; a polyalkylene glycol such as diethylene glycol and triethylene glycol; a polyalkylene glycol ether derivative such as butyl Cellosolve; and neopentyl glycol. The polyhydric alcohol is exemplified by glycol, sorbitol, trimetylolpropane and pentaerythritol. The clathrate compound is exemplified by crown ether, cryptand and calixarene.

These dissolution aids may be used alone or in combination with at least one other. The blending amount thereof depends greatly upon the kinds of the metallic salt and the amine salt of the phosphorus-containing acid, but is usually at most 30% by weight, preferably in the range of from 0.1 to 15% by weight based on the whole amount of the composition.

The refrigerating machine oil composition according to the present invention may be optionally blended, when necessary, with any of conventional additives, such as extreme pressure agents such as phosphoric acid esters and phosphorous acid esters, phenol-based antioxidants, amine-based antioxidants, stabilizers such as phenyl glycidyl ether, cyclohexene oxide, epoxidized soy bean oil, and other epoxy compounds, inactivating agents for copper such as benzotriazole and derivatives of benzotriazole, and defoaming agent such as a silicone oil and a fluorinated silicone oil.

The refrigerant to be used in the refrigerating machine to which is applied the refrigerating machine oil composition of the present invention, is not specifically limited, but is exemplified by 1,1,1,2-tetrafluoroethane (R134a); dichlorofluoromethane (R12); chlorodifluoromethane (R22), mixture of chlorodifluoromethane and 1-chloro-1,1,2,2,2-pentafluoroethane (R-502); 1,1-difluoroethane (R152a); pentafluoroethane (R125); 1,1,1-trifluoroethane (R143a); difluoromethane (R32); mixture of difluoromethane (R32) and pentafluoroethane (R125)[R410a, R410b]; mixture of pentafluoroethane (R125) and 1,1,1-trifluoroethane (R143a) [R507]; mixture of pentafluoroethane (R125), 1,1,1-trifluoroethane (R143a) and 1,1,1,2-tetrafluoroethane (R134a) [R404a]; mixture of 1,1,1,2-tetrafluoroethane (R134a), difluoromethane (R32) and pentafluoroethane (R125)[R407c]; trifluoromethane(R23); 1,3-dichloro-1,1,2,2,3-pentafluoropropane (R225cb); 3,3-dichloro-1,1,1,2,2-pentafluoropropane (R225ca); 1,1-dichloro-2,2,2-trifluoroethane (R141b); 1,1-dichloro-2,2,2-trifluoroethane (R123); 1-chloro-1,1-difluoroethane (R142b); and 2-chloro-1,1,1,2-tetrafluoroethane (R124), among which the hydrofluorocarbons typified by R134a and mixtures thereof are preferable.

The refrigerating machine oil composition according to the present invention has excellent lubricating performance, enhances lubricity between an aluminum material and steel moterial, can suppress seizure and wear therebetween, does not bring about environmental pollution and thus is well suited as the lubricating oil for a refrigerating machine using, as the refrigerant, a hydrogen-containing Flon compound such as R134a.

In the following, the present invention will be described in detail with reference to working examples, which however shall not limit the present invention thereto.

EXAMPLES 1 TO 47 AND COMPARATIVE EXAMPLES 1 & 2

Refrigerating machine oil compositions were prepared by blending the base oil whose kind is shown in Table 1, the additive A and additive B (dissolution aid) whose kinds are also shown in Table 1 in blending amounts based on the whole amount of the composition as shown in Table 1. Each of the resultant composition was subjected to visual observation of the appearance, seizure test, wear test and sealed tube test by the following procedures to evaluate each performance. The results are given in Table 2. In each of Examples 45 to 47, the following tests were carried out by substituting R410a for R134a.

(1) Seizure Test

By the use of a Falex tester, a pin/block material (specification:A 4032/AISI-C-1137) was set, and the pin was coated with 4 microliter of a sample oil. The inside of a testing vessel was made into an atmosphere of R134a, and a measurement was made of the period of time until seizure (seizure durability) under the conditions including room temperature, a working load of 150 Lbs, and a number of revolutions of 1200 r.p.m.

(2) Wear Test

By the use of a Falex tester, a pin/block material (specification: A4032/AISI-C-1137) was set. In a testing vessel were placed 200 g of a sample oil and 200 g of the refrigerant (R134a), and thereafter the pin was subjected to wear test under the conditions including an oil temperature of 50° C., a working load of 400 Lbs, a number of revolutions of 290 r.p.m and a testing time of 60 minutes to measure the wear loss of the pin.

(3) Sealed Tube Test

A glass tube was charged with a catalyst composed of Fe/Cu/Al, one g of the refrigerant (R134a), 4 milliliter (mL) of a sample oil and air so as to keep an internal pressure of 40 torr, and then was hermetically sealed. The sample oil was allowed to stand at 170° C. for 10 days. Thereafter, visual observation was made of the appearances of the sample oil and the catalyst, the total acid number of the oil was determined, and sludge formation in the oil was checked.

TABLE 1-1

| | Kind | Additive A | | Additive B (dissolution aid) | |
|---|---|---|---|---|---|
| | of base oil | Kind | Blending amout (wt %) | Kind | Blending amount (wt %) |
| Example 1 | 1 | dipotassium lauryl phosphate | 0.01 | — | — |
| Example 2 | 1 | dipotassium lauryl phosphate | 0.3 | — | — |
| Example 3 | 1 | dipotassium lauryl phosphate | 1 | dipropylene glycol | 1 |
| Example 4 | 1 | potassium dilauryl phosphate | 0.3 | — | — |
| Example 5 | 1 | lithium dioleyl phosphate | 0.3 | dipropylene glycol | 0.3 |
| Example 6 | 1 | sodium dilauryl phosphate | 0.3 | dipropylene glycol | 0.3 |
| Example 7 | 1 | dipotassium butyl phosphate | 0.3 | dipropylene glycol | 0.3 |
| Example 8 | 1 | disodium phosphate lauryl ether (4 mols EO added) | 1 | dipropylene glycol | 1 |
| Example 9 | 1 | disodium phosphate | 1 | dipropylene | 1 |

TABLE 1-1-continued

| | Kind of base oil | Additive A Kind | Additive A Blending amout (wt %) | Additive B (dissolution aid) Kind | Additive B (dissolution aid) Blending amount (wt %) |
|---|---|---|---|---|---|
| | | oleyl ether (4 mols EO added) | | glycol | |
| Example 10 | 1 | disodium oleyl phosphonate | 0.3 | dipropylene glycol | 0.3 |
| Example 11 | 1 | sodium phosphate ($Na_3PO_4$) | 0.05 | 18-crown-6 | 2 |
| Example 12 | 1 | potassium phosphate ($K_3PO_4$) | 0.1 | 18-crown-6 | 2 |
| Example 13 | 1 | potassium hydrogen-phosphate ($K_2HPO_4$) | 0.05 | dipropylene glycol | 10 |
| Example 14 | 1 | Sodium diphosphate | 0.1 | 18-crown-6 | 2 |
| Example 15 | 1 | dipotassium oleyl phosphate | 0.3 | — | — |

TABLE 1-2

| | Kind of base oil | Additive A Kind | Additive A Blending amount (wt %) | Additive B (dissolution aid) Kind | Additive B (dissolution aid) Blending amount (wt %) |
|---|---|---|---|---|---|
| Example 16 | 2 | dipotassium lauryl phosphate | 0.3 | — | — |
| Example 17 | 2 | dipotassium oleyl phosphonate | 0.3 | — | — |
| Example 18 | 2 | potassium phosphate ($K_3PO_4$) | 0.05 | 18-crown-6 | 2 |
| Example 19 | 3 | dipotassium lauryl phosphate | 0.3 | — | — |
| Example 20 | 4 | dipotassium lauryl phosphate | 0.3 | — | — |
| Example 21 | 5 | dipotassium lauryl phosphate | 0.3 | — | — |
| Example 22 | 6 | dipotassium lauryl phosphate | 0.3 | — | — |
| Example 23 | 7 | dipotassium lauryl phosphate | 0.3 | — | — |
| Example 24 | 8 | dipotassium lauryl phosphate | 0.05 | dipropylene glycol | 5 |
| Example 25 | 9 | disodium lauryl phosphate | 0.05 | dipropylene glycol | 5 |
| Example 26 | 10 | dipotassium lauryl phosphate | 0.05 | dipropylene glycol | 5 |
| Example 27 | 11 | dipotassium lauryl phosphate | 0.05 | dipropylene glycol | 5 |
| Example 28 | 1 | octylamime phosphate | 0.5 | dipropylene glycol | 1 |
| Example 29 | 1 | bis(dioctylamine) phosphate | 0.5 | — | — |
| Example 30 | 1 | ammonium oleyl phosphate | 1 | dipropylene glycol | 1 |
| Example 31 | 1 | octylamine dioleyl phosphate | 1 | — | — |
| Example 32 | 1 | octylamine dioleyl phosphonate | 1 | — | — |
| Example 33 | 1 | octylamine dioleyl phosphate | 0.5 | — | — |

TABLE 1-3

| | Kind of base oil | Additive A Kind | Additive A Blending amount (wt %) | Additive B (dissolution aid) Kind | Additive B (dissolution aid) Blending amount (wt %) |
|---|---|---|---|---|---|
| Example 34 | 1 | sodium dioleyl phosphite | 0.5 | dipropylene glycol | 0.3 |
| Example 35 | 2 | octylamine dioleyl phosphate | 0.1 | — | — |
| Example 36 | 3 | octylamine dioleyl phosphate | 0.5 | — | — |
| Example 37 | 4 | octylamine dioleyl phosphate | 1 | — | — |
| Example 38 | 5 | octylamine dioleyl phosphate | 1 | — | — |
| Example 39 | 6 | octylamine dioleyl phosphate | 1 | — | — |
| Example 40 | 7 | octylamine dioleyl phosphate | 1 | — | — |
| Example 41 | 8 | octylamine dioleyl phosphate | 0.05 | dipropylene glycol | 0.3 |
| Example 42 | 9 | octylamine dioleyl phosphate | 0.05 | dipropylene glycol | 0.3 |
| Example 43 | 10 | oclylamine dioleyl phosphate | 0.05 | dipropylene glycol | 0.3 |
| Example 44 | 11 | octylamine dioleyl phosphate | 0.05 | dipropylene glycol | 0.3 |
| Example 45 | 1 | dipotassium lauryl phosphate | 1 | dipropylene glycol | 0.3 |
| Example 46 | 2 | dipotassium oleyl phosphonate | 0.3 | — | — |
| Example 47 | 1 | octylamine dioleyl phosphate | 1 | — | — |
| Comp. * Example 1 | 1 | tricresyl phosphate | 1.0 | — | — |
| Comp. * Example 2 | 1 | trifluorochloro-ethylene | 0.5 | — | — |

* Comp. means "Comparative"

TABLE 2-1

| | Evaluation of refrigerating machine oil composition | | | | | | |
|---|---|---|---|---|---|---|---|
| | | Time until | Wear | Sealed tube test | | | |
| | Oil appearance | seizure (sec) | loss (mg) | oil appearance | catalyst appearance | total acid number | sludge formation |
| Example 1 | good | 18 | 0.9 | good | good | 0.1> | no |
| Example 2 | good | 36 | 0.3 | good | good | 0.1> | no |
| Example 3 | good | 63 | 0.1> | good | good | 0.1> | no |
| Example 4 | good | 39 | 0.3 | good | good | 0.1> | no |
| Example 5 | good | 33 | 0.3 | good | good | 0.1> | no |
| Example 6 | good | 40 | 0.2 | good | good | 0.1> | no |
| Example 7 | good | 45 | 0.1 | good | good | 0.1> | no |
| Example 8 | good | 74 | 0.3 | good | good | 0.1> | no |
| Example 9 | good | 68 | 0.3 | good | good | 0.1> | no |
| Example 10 | good | 31 | 0.5 | good | good | 0.1> | no |
| Example 11 | good | 52 | 0.1 | good | good | 0.1> | no |
| Example 12 | good | 109 | 0.1 | good | good | 0.1> | no |
| Example 13 | good | 45 | 0.3 | good | good | 0.1> | no |
| Example 14 | good | 70 | 0.2 | good | good | 0.1> | no |
| Example 15 | good | 32 | 0.5 | good | good | 0.1> | no |
| Example 16 | good | 35 | 0.4 | good | good | 0.1> | no |
| Example 17 | good | 29 | 0.7 | good | good | 0.1> | no |
| Example 18 | good | 48 | 0.2 | good | good | 0.1> | no |
| Example 19 | good | 23 | 3.5 | good | good | 0.1> | no |
| Example 20 | good | 21 | 9.2 | good | good | 0.1> | no |
| Example 21 | good | 22 | 8.1 | good | good | 0.1> | no |
| Example 22 | good | 24 | 5.6 | good | good | 0.1> | no |
| Example 23 | good | 21 | 9.7 | good | good | 0.1> | no |

TABLE 2-1-continued

| | Evaluation of refrigerating machine oil composition | | | | | | |
|---|---|---|---|---|---|---|---|
| | | Time until | Wear | Sealed tube test | | | |
| | Oil appearance | seizure (sec) | loss (mg) | oil appearance | catalyst appearance | total acid number | sludge formation |
| Example 24 | slighty cloudy | 31 | 0.3 | good | good | 0.1> | no |

TABLE 2-2

| | Evaluation of refrigerating machine oil composition | | | | | | |
|---|---|---|---|---|---|---|---|
| | | Time until | Wear | Sealed tube test | | | |
| | Oil appearance | seizure (sec) | loss (mg) | oil appearance | catalyst appearance | total acid number | sludge formation |
| Example 25 | slighty cloudy | 35 | 0.3 | good | good | 0.1> | no |
| Example 26 | good | 43 | 0.3 | good | good | 0.1> | no |
| Example 27 | slighty cloudy | 44 | 0.3 | good | good | 0.1> | no |
| Example 28 | good | 28 | 0.7 | good | good | 0.9 | no |
| Example 29 | good | 25 | 0.4 | good | good | 0.5 | no |
| Example 30 | good | 23 | 0.9 | good | good | 0.2 | no |
| Example 31 | good | 36 | 0.1> | good | good | 0.3 | no |
| Example 32 | good | 25 | 0.2 | good | good | 0.2 | no |
| Example 33 | good | 26 | 0.2 | good | good | 0.3 | no |
| Example 34 | good | 33 | 0.1 | good | good | 0.1> | no |
| Example 35 | good | 21 | 0.9 | good | good | 0.1> | no |
| Example 36 | good | 28 | 0.3 | good | good | 0.1 | no |
| Example 37 | good | 31 | 0.3 | good | good | 1.3 | no |
| Example 38 | good | 30 | 0.5 | good | good | 0.3 | no |
| Example 39 | good | 31 | 0.2 | good | good | 0.3 | no |
| Example 40 | good | 25 | 0.7 | good | good | 1.2 | no |
| Example 41 | good | 28 | 0.4 | good | good | 0.1> | no |
| Example 42 | good | 29 | 0.5 | good | good | 0.1> | no |
| Example 43 | good | 24 | 0.7 | good | good | 0.1> | no |
| Example 44 | good | 25 | 0.6 | good | good | 0.1> | no |
| Example 45 | good | 59 | 0.1> | good | good | 0.1> | no |
| Example 46 | good | 27 | 0.8 | good | good | 0.1> | no |
| Example 47 | good | 33 | 0.1> | good | good | 0.3 | no |

TABLE 2-3

| | Evaluation of refrigerating machine oil composition | | | | | | |
|---|---|---|---|---|---|---|---|
| | | Time until | Wear | Sealed tube test | | | |
| | Oil appearance | seizure (sec) | loss (mg) | oil appearance | catalyst appearance | total acid number | sludge formation |
| Comp. * Example 1 | good | 3 | 58 | good | good | 0.1> | no |
| Comp. * Example 2 | good | 15 | 36 | brown | discoloration | 13 | yes |

* Comp. means "Comparative"

Remarks: Kind of Base Oil

1; polyoxypropylene glycol dimethyl ether having a kinematic viscosity at 100° C. of 9.3 cSt and a molecular weight of 1150.

2; polyoxyethylenepolyoxypropylene glycol dimethyl ether having a kinematic viscosity at 100° C. of 20.5 cSt and a molecular weight of 1590.

3; polyoxypropylene glycol monobutyl ether having a kinematic viscosity at 100° C. of 10.8 cSt and a molecular weight of 1000 (trade name: "Unilube MB11").

4; polyoxypropylene glycol diacetate having a kinematic viscosity at 100° C. of 10.2 cSt and a molecular weight of 980.

5; polyoxypropylene glycol dimethyl carbonate having a kinematic viscosity at 100° C. of 9.6 cSt and a molecular weight of 850.

6; ether ketone compound having a kinematic viscosity at 100° C. of 15.4 cSt and a molecular weight of 1250.

7; ester compound having a kinematic viscosity at 100° C. of 10.2 cSt, produced by LCI (trade name: "Emcalate RL 68 Se")

8; Fluorinated oil having a kinematic viscosity at 100° C. of 11.1 cSt, produced by Japan Montedison Co., Ltd. (trade name: "Fombl in Y-25")

9; Fluorinated silicone oil having a kinematic viscosity at 100° C. of 35.6 cSt, produced by Shin-Etsu Silicone Co., Ltd. (trade name: FL-100-450).

10; alkylbenzene having a kinematic viscosity at 100° C. of 4.6 cSt, produced by Mitsubishi Petrochemical Co., Ltd. (trade name: "IM200").

11; mineral oil having a kinematic viscosity at 100° C. of 5.5 cSt and a sulfur content of 0.1% or less by weight.

EO; ethylene oxide

INDUSTRIAL APPLICABILITY

The refrigerating machine oil composition according to the present invention has excellent lubricating performance, enhances lubricity between an aluminum material and steel material, can suppress seizure and wear therebetween, does not bring about environmental pollution and thus is well suited as the lubricating oil for a refrigerating machine using, as the refrigerant, a hydrogern-containing Flon compound such as R134a.

Accordingly, the refrigerating machine oil composition according to the present invention is particularly effective when used for automobile air conditioners, room air conditioners, refrigerators and the like, thus rendering itself highly valueable in the field of industrial application.

I claim:

1. A refrigerating machine oil composition which consists essentially of, in the form of a blend, a hydrofluorocarbon or a mixture of hydrofluorocarbons as refrigerant in a refrigerant machine;

a base oil consisting essentially of an oxygen-containing organic compound selected from the group consisting of a polyalkylene glycol, a polyvinyl ether, a polyester, a polyol ester, a polyether ketone and a fluorinated oil, said polyester being of the unit formula (XIV):

(XIV)

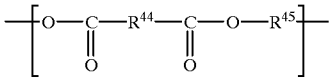

wherein $R^{44}$ is a $C_{1-10}$ alkylene group and $R^{45}$ is a $C_{2-10}$-alkylene group or a $C_{4-20}$ oxaalkylene group, and said polyol ester being of the formula (XV):

(XV)

$$R^{46}(OCOR^{47})_e$$

wherein $R^{46}$ is a hydrocarbon group and $R^{47}$ is hydrogen or a $C_{1-22}$ hydrocarbon group; and an amine salt of an organic phosphoric acid, said organic phosphoric acid being represented by the formula (XXVI):

(XXVI)

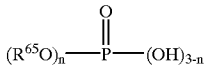

wherein $R^{65}$ is a n-alkyl group, an isoalkyl group, an alkenyl group, an alicyclic hydrocarbon group, an aromatic hydrocarbon group or an aromatic-aliphatic hydrocarbon group, said n-alkyl group and isoalkyl group having as most 20 carbon atoms, and n is 1 or 2; or by the formula (XXVII):

(XXVII)

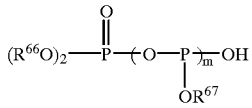

wherein $R^{66}$ and $R^{67}$ are each hydrogen atom, an aliphatic hydrocarbon group, an alicyclic hydrocarbon group, an aromatic hydrocarbon group or an aromatic-aliphatic hydrocarbon group and may be the same as or different from each other, but at least one of them is a hydrocarbon group, and m is an integer of 1 to 4; or by the formula (XXVIII):

(XXVIII)

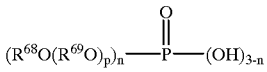

wherein $R^{68}$ is an aliphatic hydrocarbon group, an alicyclic hydrocarbon group, an aromatic hydrocarbon group or an aromatic-aliphatic hydrocarbon group, $R^{69}$ is an alkylene group having 2 to 4 carbon atoms, p is a number of 1 to 10, and n is 1 or 2.

2. The refrigerating machine oil composition according to claim 1, wherein the amine salt is a salt of ammonia or mono-, di-, or tri-hydrocarbylamine.

3. The refrigerating machine oil composition according to claim 2, wherein the hydrocarbyl group of the mono-, di-, or tri-hydrocarbylamine is an alkyl group having 1 to 40 carbon atoms or an unsaturated alkyl group having 1 to 40 carbon atoms.

4. The refrigerating machine oil composition according to claim 1, wherein the amine salt of the organic phosphoric acid is selected from the group consisting of ammonium oleyl phosphate, monooctylamine dioleyl phosphate, bisdecylamine oleyl phosphate, mono(trioctylamine) dioleyl phosphate and bis(dioctylamine) lauryl phosphate.

5. The refrigerating machine oil composition according to claim 1, wherein the blending amount of the amine salt of the organic phosphoric acid is 0.001 to 10% by weight based on the whole amount of the composition.

6. The refrigerating machine oil composition according to claim 1, wherein the blending amount ratio of the amine salt of the organic phosphoric acid is 0.01 to 5% by weight based on the whole amount of the composition.

7. The refrigerating machine oil composition according to claim 1, wherein the base oil has a kinemetic viscosity at 100° C. of from 1 to 100 cSt.

8. The refrigerating machine oil composition according to claim 1 which further comprises a dissolution aid.

9. The refrigerating machine oil composition according to claim 1, wherein $R^{65}$ has 4 to 20 carbon atoms.

10. The refrigerating machine oil composition according to claim 1, wherein the n-alkyl and isoalkyl group of $R^{65}$ of the amine salt of an organic phosphoric acid of formula (XXVI) is a methyl group, ethyl group, n-propyl group, isopropyl group, isobutyl group, pentyl group, isopentyl group, n-hexyl group, isohexyl group, n-heptyl group, isoheptyl group, n-octyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isooctadecyl group, n-nonadecyl group, isononadecyl group, n-eicosyl group, isoeicosyl group or oleyl group.

11. The refrigerating machine oil composition according to claim 1, wherein the amine salt of an organic phosphoric acid is of the formula (XXVI).

12. The refrigerating machine oil composition according to claim 1, wherein the amine salt of an organic phosphoric acid is of the formula (XXVII).

13. The refrigerating machine oil composition according to claim 1, wherein the amine salt of an organic phosphoric acid is of the formula (XXVIII).

* * * * *

UNITED STATES PATENT AND TRADEMARK OFFICE

CERTIFICATE OF CORRECTION

PATENT NO. : 5,997,761

DATED : December 7, 1999

INVENTOR(S): Masato KANEKO

It is certified that an error appears in the above-identified patent and that said Letters Patent is hereby corrected as shown below:

On the title page, item [30], the Foreign Application Priority Data has been omitted. It should read as follows:

--[30] Foreign Application Priority Data

Oct. 5, 1994 [JP] Japan.....6-240971--

Signed and Sealed this

Thirty-first Day of October, 2000

*Attest:*

Q. TODD DICKINSON

*Attesting Officer*

*Director of Patents and Trademarks*